US011446190B2

(12) United States Patent
Chicinas

(10) Patent No.: US 11,446,190 B2
(45) Date of Patent: Sep. 20, 2022

(54) BED SYSTEM FOR ATTACHMENT TO A HOSPITAL BED FOR TURNING A PATIENT

(71) Applicant: CARETURNER A/S, Herlev (DK)

(72) Inventor: Viorel Chicinas, Viborg (DK)

(73) Assignee: CARETURNER A/S, Herlev (DK)

( * ) Notice: Subject to any disclaimer, the term of this patent is extended or adjusted under 35 U.S.C. 154(b) by 299 days.

(21) Appl. No.: 16/091,429

(22) PCT Filed: Apr. 5, 2017

(86) PCT No.: PCT/DK2017/050107
§ 371 (c)(1),
(2) Date: Oct. 4, 2018

(87) PCT Pub. No.: WO2017/174091
PCT Pub. Date: Oct. 12, 2017

(65) Prior Publication Data

US 2019/0151169 A1 May 23, 2019

(30) Foreign Application Priority Data

Apr. 6, 2016 (PA) ..... PA 2016 70202

(51) Int. Cl.

| | |
|---|---|
| ***A61G 7/00*** | (2006.01) |
| ***A61G 7/002*** | (2006.01) |
| ***A61G 7/057*** | (2006.01) |
| ***A61G 7/05*** | (2006.01) |

(52) U.S. Cl.
CPC ..... *A61G 7/001* (2013.01); *A61G 7/002* (2013.01); *A61G 7/057* (2013.01); *A61G 7/0507* (2013.01)

(58) Field of Classification Search
CPC ..... A61G 7/001; A61G 7/002; A61G 7/057; A61G 7/0507
See application file for complete search history.

(56) References Cited

U.S. PATENT DOCUMENTS

| | | | |
|---|---|---|---|
| 2,113,286 | A | 2/1936 | White |
| 3,230,554 | A | 1/1966 | Peterson |
| 4,658,451 | A | 4/1987 | Taniguchi |

(Continued)

FOREIGN PATENT DOCUMENTS

| | | | |
|---|---|---|---|
| CN | 2812895 | Y | 9/2006 |
| CN | 202908987 | U | 5/2013 |

(Continued)

OTHER PUBLICATIONS

International Search Report and Written Opinion from international Application No. PCT/DK2017/050107, dated Jun. 20, 2017.

(Continued)

*Primary Examiner* — Peter M. Cuomo
*Assistant Examiner* — Adam C Ortiz
(74) *Attorney, Agent, or Firm* — Merchant & Gould P.C.

(57) ABSTRACT

There is provided a bed system for turning a patient, which system is simple to install on existing beds and which does not require any modification of the existing bed. The bed system has a base frame with attachment means for attachment of the bed system to an existing frame of a hospital bed. First and second sections with bed elements ensure proper support for the patient, and these sections are pivotally movable around an axis parallel with the length of the patient.

10 Claims, 3 Drawing Sheets

(56) References Cited

U.S. PATENT DOCUMENTS

| | | | |
|---|---|---|---|
| 5,224,228 | A | 7/1993 | Larrimore |
| 5,659,905 | A | 8/1997 | Palmer, Jr. et al. |
| 5,699,566 | A | 12/1997 | Chuang |
| 2006/0085913 | A1 | 4/2006 | Kawakami et al. |
| 2008/0222811 | A1 | 9/2008 | Gilbert et al. |
| 2015/0359693 | A1 | 12/2015 | Lyon |

FOREIGN PATENT DOCUMENTS

| | | | | |
|---|---|---|---|---|
| CN | 203815756 | U | 9/2014 | |
| DK | 178012 | B1 | 3/2015 | |
| DK | 178222 | B1 | 8/2015 | |
| EP | 0674893 | A | 10/1995 | |
| EP | 1364635 | A1 | 11/2003 | |
| EP | 1486191 | A1 | 12/2004 | |
| FR | 2972628 | A1 * | 9/2012 | ..... A61G 7/001 |
| GB | 2345439 | A | 7/2000 | |
| WO | 2016/032310 | A1 | 3/2016 | |

OTHER PUBLICATIONS

Office Action for Chinese Patent Application No. 201780021921.8 dated Nov. 28, 2019 (with English translation, 15 pages).
Office Action for Chinese Patent Application No. 201780021921.8 dated Sep. 23, 2020, 5 pages (with English translation, 13 pages).
Office Action for Chinese Patent Application No. 201780021921.8 dated Mar. 19, 2021 (with English translation, 10 pages).
Office Action for Danish Patent Application No. PA 2016 70202 dated Oct. 6, 2016, 3 pages.
Office Action for Danish Patent Application No. PA 2016 70202 dated Dec. 2, 2016, 2 pages.
Office Action for Danish Patent Application No. PA 2016 70202 dated Nov. 2, 2017, 3 pages.
Extended European Search Report for European Patent Application No. 17778710.8 dated Sep. 26, 2019, 8 pages.

* cited by examiner

BED SYSTEM FOR ATTACHMENT TO A HOSPITAL BED FOR TURNING A PATIENT

This application is a National Stage Application of PCT/DK2017/050107, filed 5 Apr. 2017, which claims benefit of Serial No. PA 2016 70202, filed 6 Apr. 2016 in Denmark, and which applications are incorporated herein by reference. To the extent appropriate, a claim of priority is made to each of the above disclosed applications.

FIELD OF THE INVENTION

This invention relates to a bed system having multiple sections that can be moved in order to avoid bed sores.

BACKGROUND OF THE INVENTION

Elderly and disabled people who spend long periods of time in bed are susceptible to bedsores. These people must be turned frequently in order to reduce the likelihood of bedsores. At present, health and safety regulations stipulate that three people must be used to turn the occupant of the bed. This is not efficient. In addition, large strains are placed on the back of the people turning the person over.

In addition, elderly, disabled people and people with motor control problems are at risk of falling out of bed, whether asleep or awake. This is a further problem in that the person may not be able to get back into the bed or even to raise an alarm. Barriers can be placed on the sides of the beds but these barriers may cause injury to the person or one of their limbs by striking the barriers.

A great number of disabled people find it impossible to either adjust their sleeping position or to arise from a prone position, i. e. at night when having retired to bed, without the help of another person which can be costly and inconvenient. In addition, the disabled person experiences a lack of independence.

It is of extreme importance that a disabled person has to be turned or to have their position adjusted at regular intervals to maintain good circulation, ease cramps and avoid bedsores, which can occur by remaining in one position for long periods.

Wheelchair users find it difficult to straighten their legs easily in bed. Frequently, disabled people or their helpers will place a pillow below their knees in order to raise their knees and to maintain the legs in a more comfortable slightly bent position. However, the pillow becomes more compact and the support provided reduces and, also, the pillow does not provide support across the full width of the bed. Furthermore, the pillow position may move and stable support is not provided.

U.S. Pat. No. 2,113,286 discloses a hospital bed where the frame and mattress are divided longitudinally and each section pivots 90 degrees from the horizontal. The hospital bed has guardrails and the pivotal movement is accomplished in a manual fashion. The bed is secured in an angular position through the use of support members resting in notches.

U.S. Pat. No. 3,230,554 discloses a motion regulator device to control the relative movement of objects. This device uses a motorized power screw to regulate relative motion in mechanical systems. The device relates specifically to the application of such devices to adjustable beds, chairs or sofas to regulate relative movement between various sections thereof.

U.S. Pat. No. 4,658,451 discloses a carrier for supporting a person in different postural positions. It contains a hydraulic drive means for pivoting the main rest area to allow the patient to be turned over, supported on their side or transferred.

EP1486191A1 discloses an adjustable bed system for turning a patient. The bed system includes a tilt mechanism adapted to tilt the platform surface laterally, a side member disposed on a side of the platform, a side-member lift mechanism adapted to raise the side member relative to the platform surface, and the tilt mechanism tilting the platform surface toward the side member raised by the side-member lift mechanism. Meanwhile, it does not include sliding means horizontally movable perpendicular to the central longitudinal axis of a hospital bed, when the bed system is attached to said hospital bed.

DK178222B B1 discloses a bed system to be installed on existing hospital beds. The bed system has a first and a second frame nested in a common pivot means, and actuators connected thereto in order to establish an angle formed between the frames, where they are rotatable about a longitudinal axis through activation of the actuators. Meanwhile, it does not involve first and second sections that are attached to the actuators in pivot points.

None of the above disclosures, taken either singly or in combination, is seen to describe the instant invention as claimed. There is a need for a simple bed system that can move specific body parts in order to avoid bed sores. Such a bed system should be easy to attach to existing hospital beds.

SUMMARY OF THE INVENTION

According to a first aspect of the present invention there is provided a bed system for turning a patient comprising:

- a base frame having attachment means for attachment of the bed system to an existing frame of a hospital bed;
- a first and a second sections having bed elements for supporting the patient, said first and second sections being pivotally movable around an axis parallel with the length of the bed system;
- a first and a second actuator, preferably linear actuators, connected to said first and second sections thereby enabling movement of the sections, each of said first and a second actuator being attached to the base frame;
- control means for moving the first and second section independently, whereby an angle formed between said first and second sections is controlled, said first and second sections being rotatable about said longitudinal axis through activation of the first and second actuator;

wherein the first section is attached to the base frame in a first pivot point (P1), and the second section is attached to the base frame in a second pivot point (P2) enabling the sections to be rotatably moved, and wherein the first section is attached to the first actuator in a third pivot point (P3), and the second section is attached to the second actuator in a fourth pivot point (P4).

In a preferred embodiment of the present invention the pivot points P1 and P3 of the first section are located in one of its ends, preferably separated by 2-8 cm. Similarly the pivot points P2 and P4 of the second section are preferably located in one of its ends, preferably separated by 2-8 cm.

The bed elements for supporting the patient are preferably flat and quadratic to ensure even support. Moreover, the bed elements for supporting the patient may provided with joints to allow bending of the bed elements.

In a second aspect the present invention provides an integrated hospital bed comprising a hospital bed, and at least two bed systems of the present invention. In this way different body parts can be moved independently.

DETAILED DESCRIPTION OF THE INVENTION

Figure 1:
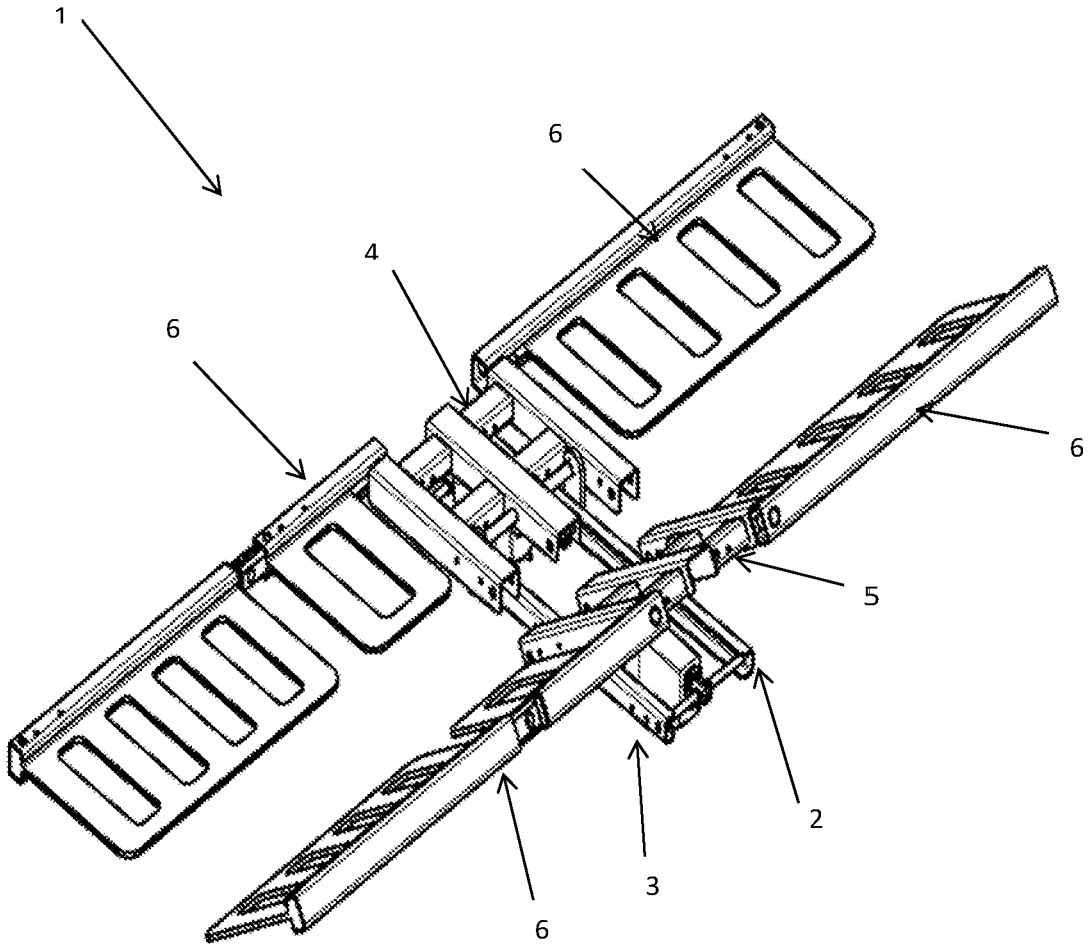
FIG. 1 is a perspective view of the bed system.

Referring to FIG. 1 there is shown a perspective view of the bed system (1) that is ready to be attached to an existing bed for turning a patient in order to avoid pressure sores. The figure shows the base frame (2) with attachment means (3) for attachment of the bed system to an existing frame of a hospital bed. There is shown a first (4) and a second (5) section having bed elements (6) for supporting the patient. The first and second sections (4, 5) are pivotally movable around an axis (shown as E-E in FIG. 2) parallel with the length of the bed system. Control means (not shown) are provided for moving the frame.

Figure 2:
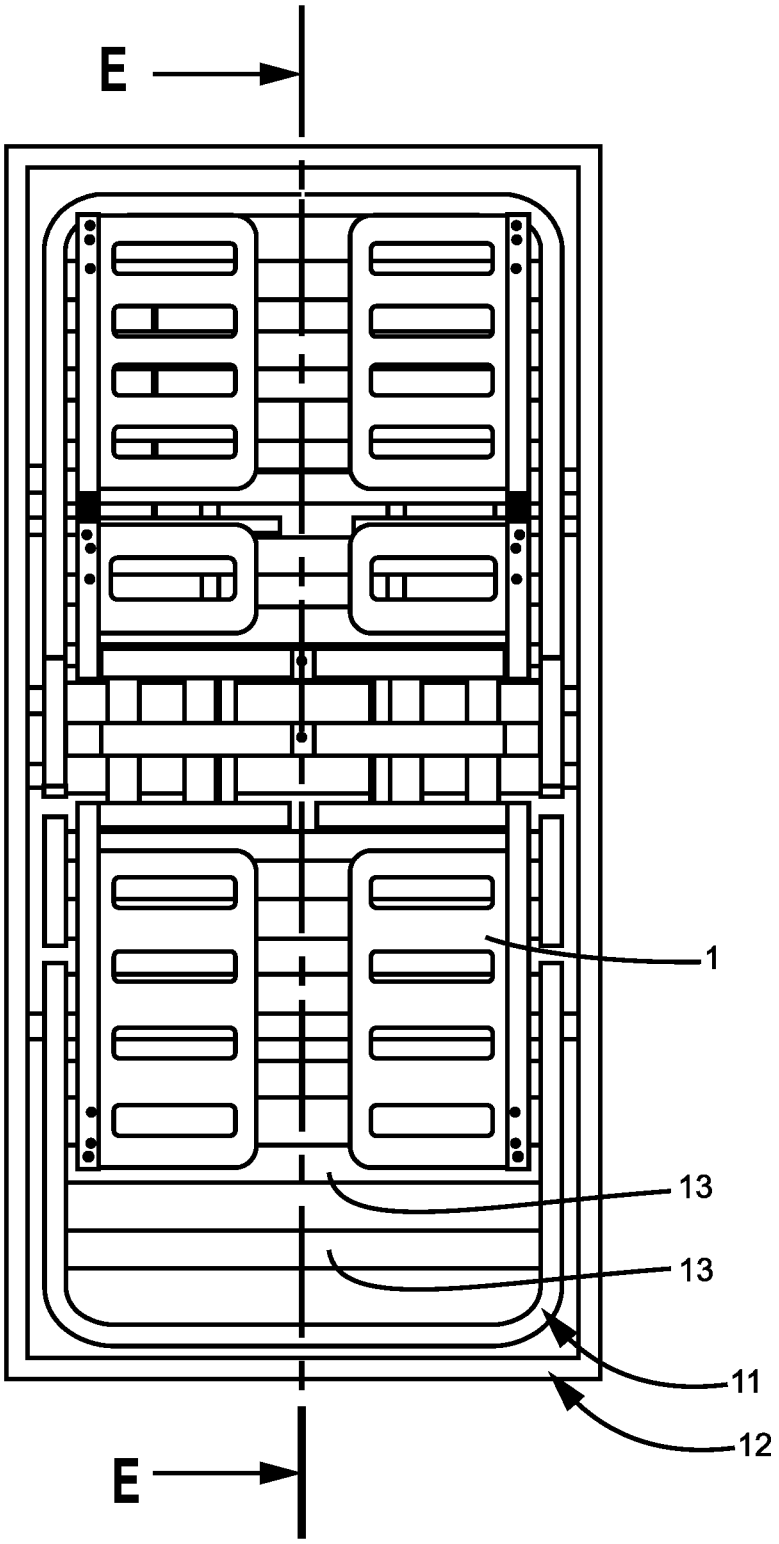
FIG. 2 is an upper view of the bed system mounted on an existing bed.

FIG. 2 shows the embodiment of FIG. 1 where the bed system (1) has been mounted on an existing bed (11), and the bed (11) includes a bed frame (12) and bed slats (13).

Figure 3:
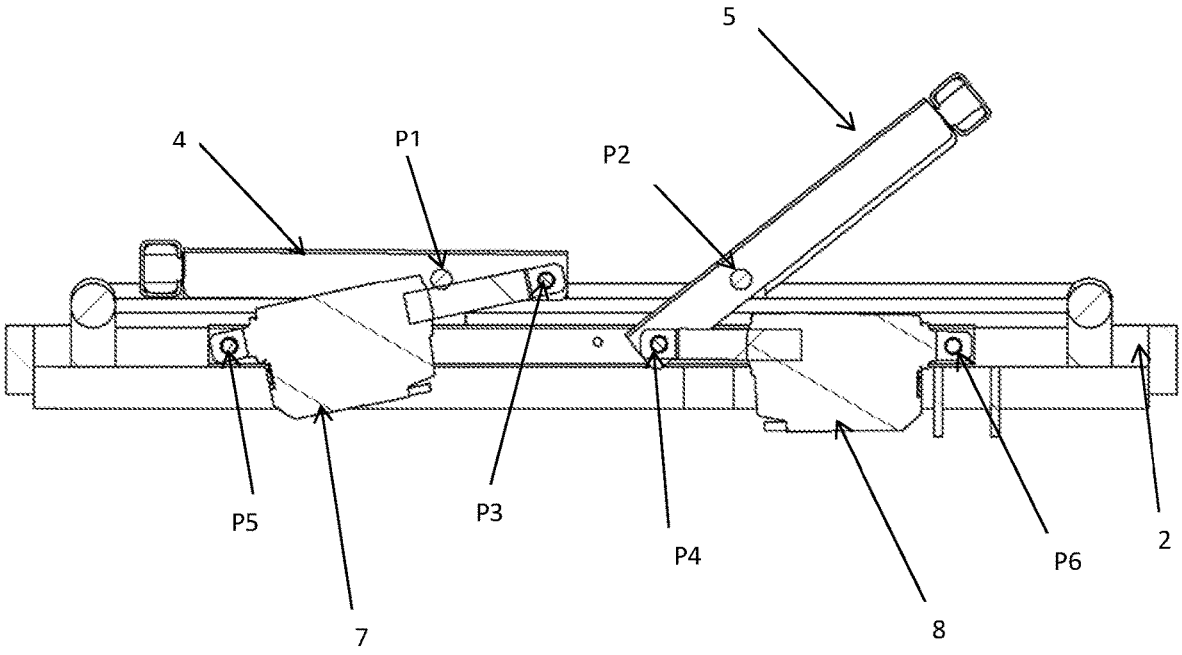
FIG. 3 shows how the first and second sections are attached to the main frame and the actuators.

In FIG. 3 there is shown how the actuators and bed sections are pivotally connected. There is shown the first (7) and a second (8) actuator connected to the first (4) and second (5) sections thereby enabling movement of the sections (4, 5). Each of the first (7) and a second (8) actuator is attached to the base frame (2). Importantly, the first section (4) is attached to the base frame in a first pivot point (P1), and the second section (5) is attached to the base frame in a second pivot point (P2) enabling the sections to be pivotally moved around these pivot points. The first section (4) is also attached to the first actuator (7) in a third pivot point (P3), and the second section (5) is attached to the second actuator (8) in a fourth pivot point (P4). Finally FIG. 3 shows that the first actuator is pivotally attached to the main frame in a pivot point (P5), and the second actuator is pivotally attached to the main frame in a pivot point (P6)

The invention claimed is:

1. A bed system for turning a patient comprising:

a base frame;

a first section and a second section having bed elements for supporting the patient, said first section and said second section being pivotally movable around an axis parallel with a length of the bed system;

a first actuator and a second actuator connected to said first section and said second section thereby enabling movement of the sections, each of said first actuator and said second actuator being attached to the base frame;

control means for moving the first section and the second section independently, whereby an angle formed between said first section and said second section is controlled, said first section and said second section being rotatable through activation of the first actuator and the second actuator;

wherein the first section is attached to the base frame in a first pivot point, and the second section is attached to the base frame in a second pivot point enabling the sections to be rotatably moved, and wherein the first section is attached to the first actuator in a third pivot point, and the second section is attached to the second actuator in a fourth pivot point, wherein the third pivot point is located closer than the first pivot point to an edge of the first section facing the second section, and the fourth pivot point is located closer than the second pivot point to an edge of the second section facing the first section.

2. A bed system according to claim 1, wherein the first actuator and the second actuator are linear actuators.

3. A bed system according to claim 1, wherein the first pivot point and the third pivot point of the first section are located in an end of the first section.

4. A bed system according to claim 1, wherein the second pivot point and the fourth pivot point of the second section are located in an end of the second section.

5. A bed system according to claim 1, wherein the bed elements for supporting the patient are flat and quadratic to ensure even support.

6. A bed system according to claim 1, wherein the bed elements for supporting the patient are provided with joints to allow bending of the bed elements.

7. A bed system according to claim 1, wherein the first actuator is pivotally attached to the main frame in a fifth pivot point, and the second actuator is pivotally attached to the main frame in a sixth pivot point.

8. A bed system according to claim 1, wherein the bed comprises a hospital bed.

9. A bed system according to claim 3, wherein the first pivot point and the third pivot point of the first section are separated by 2-8 cm.

10. A bed system according to claim 4, wherein the second pivot point and the fourth pivot point of the second section are separated by 2-8 cm.

* * * * *